United States Patent [19]

Henrion et al.

[11] Patent Number: 4,971,297

[45] Date of Patent: Nov. 20, 1990

[54] NOZZLE FOR REFINING LANCE

[75] Inventors: Romain Henrion, Esch-Alzette; Henri Klein; Francois Knaff, both of Niederkorn; Robert Mousel, Dudelange; Michel Decker, Soleuvre; Carlo Heintz, Luxembourg; Carlo Lux, Erpeldange; Patrick Derungs, Garnich; Henri Hoerold, Bettembourg; Andre Bock, Luxembourg, all of Luxembourg

[73] Assignee: Arbed S.A., Luxembourg

[21] Appl. No.: 321,031

[22] Filed: Mar. 9, 1989

[30] Foreign Application Priority Data

Mar. 11, 1988 [LU] Luxembourg ..... 87156

[51] Int. Cl.[5] ..... C21C 5/32

[52] U.S. Cl. ..... 266/225; 266/268

[58] Field of Search ..... 266/218, 225, 265, 266, 266/267, 268

[56] References Cited

U.S. PATENT DOCUMENTS

| | | | |
|---|---|---|---|
| 3,015,481 | 1/1962 | Clingensmith | 266/266 |
| 3,488,044 | 1/1970 | Shepherd | 239/132.3 |
| 3,627,294 | 12/1971 | Hill | 266/225 |
| 3,972,517 | 8/1976 | Kraizinger et al. | 266/225 |
| 4,427,186 | 1/1984 | Buhrmann | 266/225 |
| 4,730,814 | 3/1988 | Bock et al. | 266/225 |
| 4,746,103 | 5/1988 | Takashiba et al. | 266/225 |

FOREIGN PATENT DOCUMENTS

| | | | |
|---|---|---|---|
| 941159 | 2/1974 | Canada | 266/225 |
| 81448 | 6/1983 | European Pat. Off. . | |
| 234389 | 9/1987 | European Pat. Off. . | |
| 78906 | 9/1979 | Luxembourg . | |
| 255306 | 3/1970 | U.S.S.R. | 266/225 |
| 2085562 | 4/1982 | United Kingdom . | |

*Primary Examiner*—S. Kastler

*Attorney, Agent, or Firm*—Fishman, Dionne & Cantor

[57] ABSTRACT

Nozzles for a refining lance are presented which are spaced upwardly from the head of the lance and supply post-combustion oxygen to the space above a molten metal bath undergoing refining. Each of the nozzles has a mouthpiece with two parallel sharp edges which are arranged in planes passing substantially through the axis of the lance and which are connected by slightly rounded edges. Above the mouthpiece of each nozzle is a converging part.

19 Claims, 1 Drawing Sheet

NOZZLE FOR REFINING LANCE

BACKGROUND OF THE INVENTION

1. Field of the Invention

The present invention relates to the field of metallurgical refining lances. More particularly, this invention relates to a nozzle of a refining lance for supplying post-combustion oxygen to the space above a molten metal bath undergoing refining.

Refining lances are known in the prior art which have, apart from vertical nozzles supplying supersonic refining oxygen, several auxiliary nozzles. These auxiliary nozzles have angles of between 25° and 60° (see, for example, patents LU 78 906 and LU 83 814) in relation to the vertical axis. They deliver jets of oxygen for the purpose of post-combustion. Because these jets of oxygen are subsonic, the auxiliary nozzles are fed by an independent oxygen circuit which permits adjustment of delivery.

A means of increasing the degree of turbulence of the jet is also known (see Patent LU No. 82 846) and is provided in the conduits of the nozzles which guide the post-combustion oxygen. Such turbulence increasing means may comprise plates arranged in the conduits of the secondary nozzles so as to form spirals. In another embodiment, the walls of the conduits are provided with grooves which may be circular and arranged in a plane perpendicular to the axis of the conduit or may be spiral. The angles of inclination of the post-combustion oxygen jets are dictated by those of the nozzles; once they have been determined by empirical tests or methods (taking into account the angles of the primary oxygen jets, their arrangement, the dimensions of the converter, the height of the head of the lance above the bath etc.), the angles remain constant. These prior art nozzles do not permit the space above the bath to be swept with jets of oxygen and they do not permit post-combustion oxygen to be sent to the converter at an angle which varies according to the refining stage in progress. Patent LU No. 86 329 (Corresponding to U.S. Pat. No. 4,730,814, which is assigned to the assignee hereof and fully incorporated herein by reference) describes a supersonic nozzle which supplies post-combustion oxygen at a variable angle to the space above a molten metal bath. This nozzle comprises a wall along which the gas passes in a straight line before ending at a pointed edge which forms part of the mouthpiece. The nozzle is level with the top of the pointed edge, and as a result, the jet expands and is deflected by the pointed edge. The angle of deflection varies according to the pressure of the gas at the edge, i.e. the higher the pressure of the gas is at this point, the greater the angle of deflection. Conversely, the deflection effect of the edge is practically nil when the gas has a subsonic speed at this point. By varying the pressure of the gas feeding the nozzle within predetermined limits, an angle close to 30° can be swept. The resulting turbulences (from this pressure variance) in the converter favor the creation of an extended zone, permanently supplied with oxygen. Although this nozzle has a post-combustion rate superior to that of conventional nozzles, it may still be improved. Indeed, as a result of construction constraints (space available in the head of the lance) it is not possible to arrange these nozzles around the entire circumference of the head of the lance, but only in certain discrete places, so that the space is only fed in an incomplete manner.

SUMMARY OF THE INVENTION

The above discussed problems and other disadvantages of the prior art are overcome or alleviated by the lance nozzle of the present invention. The present invention comprises a nozzle which allows the creation of a practically homogeneous layer of oxygen above the molten metal bath of the converter. The nozzle is spaced upwardly from the head of the refining lance and has a mouthpiece with two parallel sharp edges which are arranged in planes passing substantially through the axis of the lance and which are connected by slightly rounded edges. The above discussed and other features and advantages of the present invention will be apparent to and understood by those skilled in the art from the following detailed description and drawings.

BRIEF DESCRIPTION OF THE DRAWINGS

Referring now to the drawings, wherein like elements are numbered alike in the serveral FIGURES:

FIG. 4 is a cross sectional view of two additional alternative embodiments of the nozzles of FIG. 1.

DESCRIPTION OF THE PRESENT INVENTION

Figure 1:
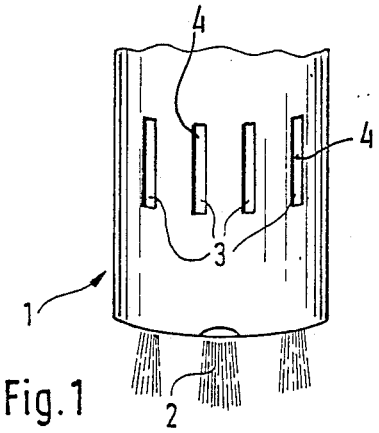
FIG. 1 is a partial front perspective view of a refining lance fitted with the nozzles of the present invention.

Referring to FIG. 1, a lance is shown generally at 1. Three refining oxygen jets 2 emerge from the head of lance 1. Spaced upwardly from the head of lance 1, at a distance of about ten centimeters, are a plurality of mouthpieces 3 of several nozzles 4 which are arranged all around the body of lance 1 and which supply post-combustion oxygen. Nozzles 4 have above mouthpieces 3 an optional throat preceded by a converging part. The vertical sides of the mouthpieces 3 have sharp, preferably pointed edges and the horizontal sides are preferably rounded. The ratio of the lengths between the elongated, sharp edges and the rounded edges is at least 3:1. Also, the sharp edges are preferably at no less than 15 mm apart from each other. The sharp edges preferably form an angle of about 90°

Nozzles 4 can be fed in parallel from a single oxygen source and a single pressure-reducing valve (See U.S. Pat. No. 4,730,814). It is necessary to ensure that oxygen supply conduits are dimensioned in a way that pressure differences (differential head losses) are avoided between nozzles 4 and between different places in a mouthpiece 3. A pressure sensor (See item 9 in U.S. Pat. No. 4,730,814) measures the actual pressure P at the entry of one of nozzles 4. This pressure P is compared with a reference pressure Po and in the event of difference, a regulation loop acts upon the degree of opening of the valve.

Pressure Po is determined by routine testing so as to have a deflection which provides a uniform supply of oxygen to the space in the area of mouthpiece 3. When nozzle 4 is supplied under a pressure which is rising from a zero pressure, a gaseous jet emerges at an increased speed. Starting at a predetermined pressure, which is dependent upon details of construction of the nozzle, the speed of the emerging gas becomes sonic. At this predetermined pressure, further increases in the supply pressure no longer have any effect on the speed of the emerging gas which remains sonic. However, further pressure increases will raise the internal pressure of the system. At the level of mouthpiece 3, the emerging gas or jet expands while forming the center of a multitude of shock waves which are the basis of an increase in speed of the jet and of its bilateral deflection. The angle of deflection varies according to the pressure of the gas at the mouthpiece (i.e. the greater the pressure of the gas at this point, the greater the deflection—and the quantity of gas deflected). Consequently, the ratio of the quantities of gas which emerge in a straight line from nozzle 4 and those which are deflected from the two lateral sides of nozzle 4 decreases upon an increase of internal pressure. A pressure range exists within which the most uniform supply of oxygen is obtained in the space opposite nozzle 4. There is also a deflection of the jet around the upper and lower sides of mouthpiece 3. However, these sides are not very wide and are slightly rounded, thus the effect is not very pronounced. While it is reasonable to expect that the refractory lining at which the emerging oxygen jet is aimed, would wear quickly; this was not observed. The oxygen jet reaches the refractory lining as a result of a braking action due to an interaction of the pressure reduction of the jet with the shock waves. The turbulence which results from the above interaction favors the combustion of carbon monoxide. This is a surprising and unexpected feature of the present invention.

Figure 2:
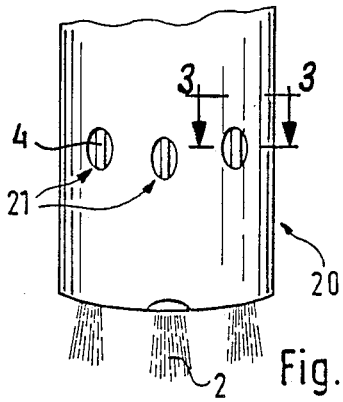
FIG. 2 is a partial front perspective view of an alternative embodiment of the nozzle of FIG. 1.
Figure 3:
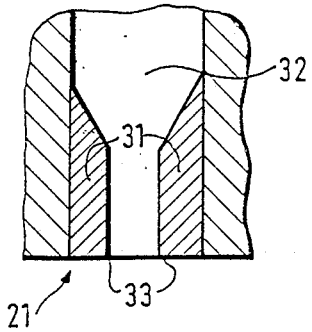
FIG. 3 is a partial cross sectional view of the nozzle of FIG. 2 along the line III—III.

Preferably, pressurized gas at the mouthpiece is at least equal to 200,000 Pascal. In many cases, the arrangement of post-combustion nozzle 4 as shown in FIG. 1 is not feasible as a result of construction constraints. However, now referring to FIG. 2, it is possible to modify a standard lance head 20 with round post combustion holes 21 (intended for subsonic blowing) to create a layer of oxygen as proposed by the present invention. To achieve this end, insertion pieces 31 are introduced into holes 21 from the outside. This forms a converging area 32 and a throat and also modifies mouthpiece 3 so that it has sharp edges 33 which are vertical and parallel. These edges (For example, about one centimeter apart), are connected at top and bottom by curved pieces which fit the profile of the original holes. Although the cross sectional area of blowing hole 21 is greatly reduced by the fitting of pieces 31, the quantity of gas blown into the space is nevertheless increased. This is a result of the supersonic speed at which the blowing is carried out.

Prior art post-combustion nozzles, when supplied under a pressure such that the oxygen jet becomes supersonic upon emerging, also deflect around mouthpiece 3. Mouthpiece deflection is not preferred because the jet only diverges around the blowing axis (with an angle of divergence proportional to the pressure) without providing, in conjunction with the neighboring jets, a continuous or homogeneous gaseous layer.

It will be appreciated that it is not inconvenient for post-combustion nozzles 4 to have an angle of several tens of degrees in relation to the vertical axis. Nozzle 4 may also be arranged in a circle surrounding the refining nozzles, on the front of the lance. The oxygen layer, instead of being horizontal as is the case in FIG. 1, will be angled towards the surface of the molten metal bath, having roughly the shape of an umbrella three quarters open. In the arrangement of nozzle 4 described with regard to FIG. 1, all the carbon monoxide emerging from the bath must cross the continuous layer of oxygen before it reaches the chimney. In this alternative embodiment, as the jets are aimed at the bath, an amount of CO emerging from the bath outside the surface area delimited by the angled layer of oxygen, will not be burnt. However, this amount of CO represents only a small proportion of the total quantity. The essential fact is that combustion takes place in this case at a shorter distance from the bath, which gives better thermal efficiency.

Figure 4A:
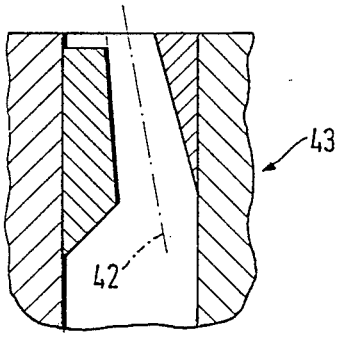
FIGS. 4*a* and 4*b* is a cross sectional view of two additional alternative embodiments of the nozzles of FIG. 1.
Figure 4B:
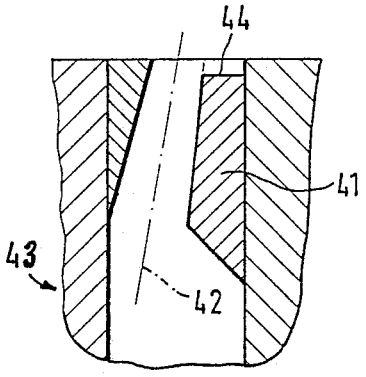

When post-combustion nozzles are not distributed uniformly on the circumference of the head of lance 1, but grouped in pairs, it is recommended that the blowing axis of the nozzles be modified so as to obtain a better distribution of oxygen in the space between two pairs of nozzles. Preferably, the axis of the nozzle is angled at up to 50° in relation to the axis of the lance. In FIG. 4*a* and 4*b* such a pair of nozzles 43 has been represented. The insertion pieces 41 have only one converging part (without a throat) and they modify blowing axis 42 of nozzle 43 in the direction of the neighboring pairs of nozzles 43. Thus, in each nozzle, one of the sharp edges is rounded and one of the sharp edges is pointed. In addition to this expedient, there is also the possibility of moving back the edges from the side of the mouthpiece neighboring the other pairs of nozzles 43 towards the inside of the body (see item 44) in such a way as to cause with these sides a deflection of the jet before it emerges from the head of lance 1. Thus, one of the sharp edge in a nozzle will be spaced back in relation to the other sharp edge.

While preferred embodiments have been shown and described, various modifications and substitutions may be made thereto without departing from the spirit and scope of the invention. Accordingly, it is to be understood that the present invention has been described by way of illustrations and not limitation.

What is claimed is:

1. A nozzle for a refining lance for supplying post-combustion oxygen to the space above a molten metal bath undergoing refining, the nozzle being positioned in the prolongation of a gas supply conduit connecting to it by means of a pressurereducing valve to a source of pressurized oxygen, the nozzle further having a mouthpiece and a converging section upstream of the mouthpiece wherein said mouthpiece comprises:

two elongated, parallel sharp edges arranged in planes which pass substantially through the axis of the refining lance, said two sharp edges being connected at top and bottom by two connecting edges; and wherein one of said sharp edges is spaced back in relation to the other of said sharp edges.

2. A nozzle for a refining lance for supplying post-combustion oxygen to the space above a molten metal bath undergoing refining, the nozzle being positioned in the prolongation of a gas supply conduit connecting to it by means of a pressure-reducing valve to a source of pressurized oxygen, the nozzle further having a mouthpiece and a converging section upstream of the mouthpiece wherein said mouthpiece comprises:

two elongated, parallel sharp edges arranged in planes which pass substantially through the axis of the refining lance, said two sharp edges being connected at top and bottom by two connecting edges.

3. The nozzle of claim 2 wherein:

the ratio of the lengths between said elongated, sharp edges and said connecting edges is at least equal to 3:1.

4. The nozzle of claim 2 wherein:

said two sharp edges are less than about 15 mm apart.

5. The nozzle of claim 2 wherein:

said sharp edges form an angle of 90°.

6. The nozzle of claim 2 further comprising: means for providing a pressurized gas stream wherein the pressure of the gas stream at said mouthpiece is at least equal to 200,000 Pascal.

7. The nozzle of claim 2 wherein:

said two elongated sharp edges are parallel to the axis of said lance.

8. The nozzle of claim 2 wherein:

the axis of said nozzle is angled at up to 50° in relation to the axis of said lance.

9. The nozzle of claim 2 further comprising:

a throat arranged between said converging section and said mouthpiece.

10. The nozzle of claim 1 wherein:

said two connecting edges are rounded.

11. A refining lance, comprising:

a longitudinally extending tubular body;

means for providing refining gas jets from an end of said body; and nozzle means for providing post-combustion gas streams, said nozzle means comprising:

a plurality of circumferentially spaced apart mouthpieces and a converging section upstream of each of said mouthpieces; each of said mouthpieces comprising:

a pair of elongated parallel straight sharp edges, each of said edges extending from a top end to a bottom end;

a first connecting edge connecting to top ends of the sharp edges; and a second connecting edge connecting the bottom ends of the sharp edges;

said elongated parallel straight sharp edges each being oriented in a plane which passes substantially through the longitudinal axis of the tubular body.

12. The nozzle of claim 11, wherein the ratio of the length of the elongated sharp edges and the connecting edges in at least equal to 3:1.

13. The nozzle of claim 11, wherein the pair of sharp edges are less than 15mm apart.

14. The nozzle of claim 11, wherein the elongated sharp edges are oriented parallel to the longitudinal axis of the body.

15. The nozzle of claim 11, wherein the elongated sharp edges are oriented at an angle of up to 50° relative to the longitudinal axis of the body.

16. The lance of claim 11 wherein one of said pair of elongated parallel straight sharp edges is spaced back in relation to the other of said pair of elongated parallel linear sharp edges.

17. The lance of claim 11, wherein said nozzle means further comprises:

a throat between each of said converging section and said mouthpieces.

18. The refining lance of claim 11, wherein each of said sharp edges forms an angle of 90°.

19. A refining lance, comprising:

a longitudinally extending tubular body;

means for providing a plurality of refining gas streams from an end of said body; and nozzle means for providing sonic post-combustion gas streams from said body, said nozzle means comprising:

a plurality of circumferentially spaced apart mouthpieces, each of said mouthpieces comprising straight edge means for providing turbulent shockwaves to said sonic post-combustion gas streams;

whereby the sonic post combustion gas streams are each bilaterally deflected to collectively form a post combustion gas umbrella that envelopes the end of the refining lance body.

* * * * *